US008132377B2

(12) United States Patent
Julton

(10) Patent No.: US 8,132,377 B2
(45) Date of Patent: Mar. 13, 2012

(54) FLOOR COVERINGS WITH WOODEN FLOORS ON A SUBSTRATE, METHOD FOR THE COVERING OF A SUBSTRATE AND USE OF STUDDED PLATES

(75) Inventor: Svein Julton, Kongsberg (NO)

(73) Assignee: ISOLA AS, Notodden (NO)

( * ) Notice: Subject to any disclaimer, the term of this patent is extended or adjusted under 35 U.S.C. 154(b) by 991 days.

(21) Appl. No.: 11/503,840

(22) Filed: Aug. 14, 2006

(65) Prior Publication Data

US 2007/0044403 A1 Mar. 1, 2007

(30) Foreign Application Priority Data

Aug. 30, 2005 (DE) ..... 20 2005 013 697 U
Dec. 2, 2005 (EP) ..... 05111659

(51) Int. Cl.
*E04F 15/00* (2006.01)

(52) U.S. Cl. ..... 52/302.1; 52/302.3; 52/385; 52/386; 52/747.11

(58) Field of Classification Search ..... 52/302.1, 52/385, 389, 449, 747.11, 386, 390, 741.14, 52/742.16, 746.11, 302.3, 302.4, 741.41, 52/741.4, 746.1, 408, 409, 410
See application file for complete search history.

(56) References Cited

U.S. PATENT DOCUMENTS

| | | | | |
|---|---|---|---|---|
| 1,277,622 A | | 9/1918 | Madison | |
| 1,302,822 A | | 5/1919 | Madison | |
| 1,430,080 A | | 9/1922 | Hicks | |
| 1,485,370 A | | 3/1924 | Cumfer | |
| 1,503,783 A | | 8/1924 | Dahlberg | |
| 1,919,354 A | | 7/1933 | Anderson | |
| 1,965,282 A | | 7/1934 | Ellithorpe et al. | |
| 2,030,556 A | | 2/1936 | Veltung | |
| 2,031,680 A | | 2/1936 | Tuthill | |
| 2,245,690 A | | 6/1941 | Krueger | |
| 2,356,309 A | * | 8/1944 | Garbe | 52/481.2 |
| 2,678,896 A | | 5/1954 | Dratler | |
| 3,025,722 A | | 3/1962 | Eger, Jr. et al. | |
| 3,086,899 A | * | 4/1963 | Ingraham et al. | 428/158 |
| 3,238,682 A | | 3/1966 | Tracy et al. | |
| 3,419,457 A | | 12/1968 | Bleasdale | |
| 3,533,896 A | | 10/1970 | Hartig | |

(Continued)

FOREIGN PATENT DOCUMENTS

DE 1 929 878 12/1970

(Continued)

OTHER PUBLICATIONS

Data Sheet "Datablad Platon Grunnmurplate D16.4", AS Platon, 2 pages, Sep. 1978.

(Continued)

*Primary Examiner* — Brian Glessner
*Assistant Examiner* — James Buckle, Jr.
(74) *Attorney, Agent, or Firm* — Myers Bigel Sibley & Sajovec

(57) ABSTRACT

It is disclosed a floor covering on a substrate with wooden floors, a method for covering a substrate with a wooden floor, and the use of a studded plate for covering of a substrate with a wooden floor, wherein:

a substrate is covered with a bonding adhesive, the substrate and bonding adhesive is covered with studded plates, the studded plates covered with an adhesive on which a wooden floor is fixed.

17 Claims, 5 Drawing Sheets

U.S. PATENT DOCUMENTS

| | | | | | |
|---|---|---|---|---|---|
| 3,554,850 | A | * | 1/1971 | Kuhle | 52/392 |
| 3,619,964 | A | * | 11/1971 | Passaro | 52/309.13 |
| 3,812,636 | A | | 5/1974 | Albrecht et al. | |
| 4,318,258 | A | | 3/1982 | Heck | |
| 4,601,147 | A | | 7/1986 | Migliore | |
| 4,637,184 | A | | 1/1987 | Radtke et al. | |
| 4,694,627 | A | * | 9/1987 | Omholt | 52/390 |
| 4,917,933 | A | | 4/1990 | Schluter | |
| 4,932,182 | A | | 6/1990 | Thomasson | |
| 5,016,413 | A | | 5/1991 | Counihan | |
| 5,042,569 | A | | 8/1991 | Siegmund | |
| 5,052,161 | A | * | 10/1991 | Whitacre | 52/385 |
| 5,255,482 | A | | 10/1993 | Whitacre | |
| 5,287,671 | A | | 2/1994 | Ueki | |
| 5,323,575 | A | | 6/1994 | Yeh | |
| 5,383,314 | A | | 1/1995 | Rothberg | |
| 5,418,036 | A | | 5/1995 | Tokikawa et al. | |
| 5,489,462 | A | | 2/1996 | Sieber | |
| 5,566,522 | A | | 10/1996 | Alander | |
| 5,572,842 | A | | 11/1996 | Stief | |
| 5,619,832 | A | | 4/1997 | Myrvold | |
| 5,775,039 | A | | 7/1998 | McPherson | |
| 5,822,937 | A | | 10/1998 | Mahony | |
| 5,927,033 | A | * | 7/1999 | Kreckl | 52/390 |
| 6,000,184 | A | | 12/1999 | Fernandes | |
| 6,151,854 | A | | 11/2000 | Gutjahr | |
| 6,261,394 | B1 | * | 7/2001 | Raineri | 156/63 |
| 6,434,901 | B1 | * | 8/2002 | Schluter | 52/302.1 |
| 6,574,938 | B1 | * | 6/2003 | Francesco et al. | 52/745.19 |
| 6,802,668 | B2 | * | 10/2004 | Parker | 405/49 |
| 6,918,215 | B2 | * | 7/2005 | Smith | 52/177 |
| 7,404,689 | B1 | * | 7/2008 | Poling | 404/31 |
| 7,721,498 | B2 | * | 5/2010 | Kang et al. | 52/428 |
| 2002/0139068 | A1 | * | 10/2002 | Janesky | 52/169.5 |
| 2003/0154676 | A1 | * | 8/2003 | Schwartz | 52/391 |

FOREIGN PATENT DOCUMENTS

| | | | |
|---|---|---|---|
| DE | 26 50 160 | A1 | 5/1978 |
| DE | 29 47 499 | B1 | 6/1981 |
| DE | 30 45 390 | A1 | 6/1982 |
| DE | 31 03 632 | A1 | 8/1982 |
| DE | 83 11 020 | U1 | 4/1983 |
| DE | 84 12 830.5 | U1 | 10/1984 |
| DE | 299 24 180 | U1 | 10/1984 |
| DE | 35 12 527 | C1 | 7/1986 |
| DE | 36 41 971 | A1 | 6/1988 |
| DE | 37 01 414 | A1 | 7/1988 |
| DE | 91 14 591 | U1 | 3/1993 |
| DE | 44 35 895 | A1 | 4/1996 |
| DE | 296 02 442 | U1 | 4/1996 |
| DE | 296 22 129 | U1 | 4/1997 |
| DE | 298 07 258 | U1 | 7/1998 |
| DE | 298 06 561 | U1 | 11/1998 |
| DE | 197 50 277 | A1 | 5/1999 |
| DE | 299 15 866 | U1 | 5/2000 |
| DE | 299 21 970 | U1 | 4/2001 |
| DE | 33 13 476 | A1 | 5/2002 |
| DE | 299 24 526 | U1 | 9/2003 |
| EP | 0 275 454 | B1 | 7/1988 |
| EP | 0 636 199 | B1 | 2/1995 |
| EP | 0 801 186 | A1 | 10/1997 |
| EP | 1022407 | * | 1/2000 |
| EP | 1 068 413 | B1 | 1/2001 |
| EP | 1 073 813 | B1 | 2/2001 |
| FR | 1 444 070 | | 7/1966 |
| FR | 2 544 460 | A1 | 10/1984 |
| GB | 2 141 459 | A | 12/1984 |
| NO | 313 942 | B1 | 10/1999 |
| NO | 77826 | | 4/2004 |
| WO | WO 82/03099 | | 9/1982 |
| WO | WO 97/04178 | A1 | 2/1997 |
| WO | WO 99/25940 | A1 | 5/1999 |
| WO | WO 99/54571 | | 10/1999 |
| WO | WO 00/42258 | | 7/2000 |
| WO | WO 99/55985 | | 7/2000 |

OTHER PUBLICATIONS

Data Sheet "Datablad Platon Grunnmurplate D12.1", AS Platon, 2 pages, Jan. 1977.

Data Sheet "Datablad Paton Grunnmurplate D16.4", AS Platon, 2 pages, Sep. 1978.

Data Sheet "Datablad Paton Grunnmurplate D12.1", AS Platon, 2 pages, Jan. 1977.

Europeen Search Report for EP 05008263; date of search Aug. 8, 2005.

Norweigian Search Report for 20041545; date of report Oct. 13, 2004.

* cited by examiner

FLOOR COVERINGS WITH WOODEN FLOORS ON A SUBSTRATE, METHOD FOR THE COVERING OF A SUBSTRATE AND USE OF STUDDED PLATES

RELATED APPLICATIONS

This application claims priority from German Patent Application No. 202005013697.2, filed on Aug. 30, 2005, and from European Patent Application Serial No. 05111659.8, filed Dec. 2, 2005, the disclosures of each of which are incorporated herein by reference in their entireties.

FIELD OF THE INVENTION

The present invention concerns floor coverings with wooden floors on a substrate, for example of concrete. The invention also concerns a method for the covering of a substrate with a floor covering and the use of a studded plate for such flooring.

BACKGROUND OF THE INVENTION

It is known to use studded plates as supporting plates. They may be used as ordinary supporting plates, drainage plates, decoupling plates, or plaster plates for plastering or support for adhesive for tiles, for example when flooring with ceramic tiles.

All concrete floors which are laid directly on the ground contain moisture. Therefore, floor coverings such as wooden floors may not be placed directly on the concrete. Many years may be needed to dry out a concrete floor which is a slab on ground construction. The floor may also be affected by rising damp. Initially, all concrete floors contain residual moisture and the above problem therefore concerns cellars, basement floors, slab on ground floors and floors between different storeys of different types of concrete, including for example floors made of light expanded clay aggregate concrete and lightweight concrete, plaster based floors, floating floors, floating floors screed or flooring substitute, generally all floors which have the feature of curing or hardening by using water. The moisture in the concrete is often invisible and difficult to detect. This results in an unawareness of the risks such as rot, moisture damage etc. Without an effective damp proof membrane with sufficient performance characteristics, moisture from the concrete will for example attack wood materials from underneath. The same problem also concerns tiled floors wherein the filled joints will allow passage of moisture.

The result is damaged floors with swelling, mould and rot. In addition, hazardous mould spores, bad smell and a poor indoor environment may result.

Studded plates are used to prevent problems related to moisture in floors. To solve such problems, "passive" venting may be provided towards the room. The studded plates often comprise hollow studs with rounded, square or other cross-sections, i.e. the form of the circumference of the studs, with a diameter or transversal length from 5 to 55 mm and a height from 1 to 10 mm. The studs are often distributed in a diamond pattern or a check pattern providing adequate distribution of the loading as well as venting. The studs can advantageously be distributed over the plate with a distance between the studs from 1 to 10 mm. The studded plates are placed with the top of the studs facing downwards toward the base floor to obtain an air gap on the underside of the plate, between the studs.

The plates may be joined by sealing tape on the topside of the plates to obtain a sealed floor. In case of severe problems with moisture, smell or other emissions, the air gap beneath the studded plates may be ventilated mechanically in order to provide air flow over the concrete surface or substrate and create a negative pressure in relation to the room. A ventilated air gap may also contribute to the drying out of the concrete.

It is furthermore known to use studded plates as a membrane between a concrete substrate and tiles laid on such substrate. The concrete substrate is covered with studded plates. The studded plate is thereafter covered by a bonding adhesive on which the tiles are laid.

However, wooden floors are also used instead of tiles in living rooms etc. Some wooden floors may be laid "floating" without bonding to the substrate. Others need to be bonded. It is therefore desirable to find a method for covering a substrate where the dampness from the concrete substrate is not affecting wooden floors which require to be bonded to the substrate.

With a "substrate" or "concrete substrate" it is here meant floors made of light expanded clay aggregate concrete and lightweight concrete, plaster based floors, floating floors, floating floors screed or flooring substitute, generally all floors which have the feature of curing or hardening by using water.

Different types of primer or adhesive are commonly used to bond wooden floors to concrete substrates. However, it has been seen that this may result in problems.

The object of the present invention is therefore to present a method for covering of a substrate with wooden floor coverings bonded to the substrate where the wooden floor or parquet or parquet strips are not in contact with or affected by humidity in the concrete floor underneath.

SUMMARY OF THE INVENTION

This is done by covering the substrate with a bonding adhesive. The substrate is covered with a layer of flexible bonding adhesive. The adhesive can be a 1 or 2 component adhesive based on cement, polymer, polyurethane, epoxy or other. A studded plate is then laid on the adhesive layer. The plates are laid in the adhesive with adjacent plates edge to edge or with a flat overlapping edge laid over the previous plate. The joints in the plates are then sealed by using a suitable sealing tape.

The studded plate may have a material such as a non-woven, a fine net or a fabric, laminated or adhered to the protruding part of the studs facing the substrate surface, so that the material bonds to the substrate surface. The material is preferably of low permeability preventing the air gap between the studs from being filled.

The studded plates are covered with an adhesive to which parquet strips or other wooden floor types can be adhered. The adhesive can be a 1 or 2 component adhesive based on polymer, polyurethane, epoxy or other. The adhesive is laid on the studded plates in such a way that the upper inside of the studs are filled with the adhesive. The wooden floor, parquet or parquet strips can then be fixed to the adhesive.

The walls of the studs may preferably comprise undercut cavities and/or overhangs. Undercuts may be obtained by shaping the studs with inclined walls with a dovetailed shaped section, such as by inverted truncated pyramids or cones, as described in EP 1 068 413 to Isola AS. Overhangs may be obtained by lips extending from the edges of the opening of the studs, such as described in EP 1 073 813 to Schlüter Systems KG. The mentioned shapes of the studs limits the area of the opening of the studs is in relation to the area of the top of the studs and thereby provide improved anchoring of the adhesive filled into the studs, and hence improved fixing of the wooden floor.

Alternatively or in addition, the openings of the studs may be covered by a permeable material, such as a non-woven, a net or a loose fabric laminated or adhered to the plate, to achieve the same effect. The adhesive will fill the studs and the permeable material will reinforce the adherence of the adhesive fixing the wooden floor to the plate.

A gap can be left between the edge of the floor and the surrounding walls. Dampness from the substrate can then easily escape from the floor. A skirting board is arranged on the lower part of the wall in such a way that it covers the edge of the floor. The skirting board is arranged so that a space is left between the wall surface and the rear surface of the board. Dampness from the floor is thus free to pass through vents in the board and diffuse into the room.

It is also possible to arrange a studded plate with a fold line adjacent to the wall in such a way that the studded plates cover the lower part of the wall surrounding the substrate floor. Such an arrangement is described in the co-pending patent application EP 05 008 263.5. The floor will then mainly be produced as described below, but without leaving a gap between the adhesive layers and the adjacent walls. The gap may thus be formed by the studded plate with fold line.

The method according to the invention produces a floor which is well protected against humidity from underneath, and tolerates changes in surrounding air humidity in the room.

The invention will now be further described by an example which is not limiting the scope of the invention which is defined by the attached claims.

DETAILED DESCRIPTION OF EMBODIMENTS OF THE INVENTION

Figure 1:
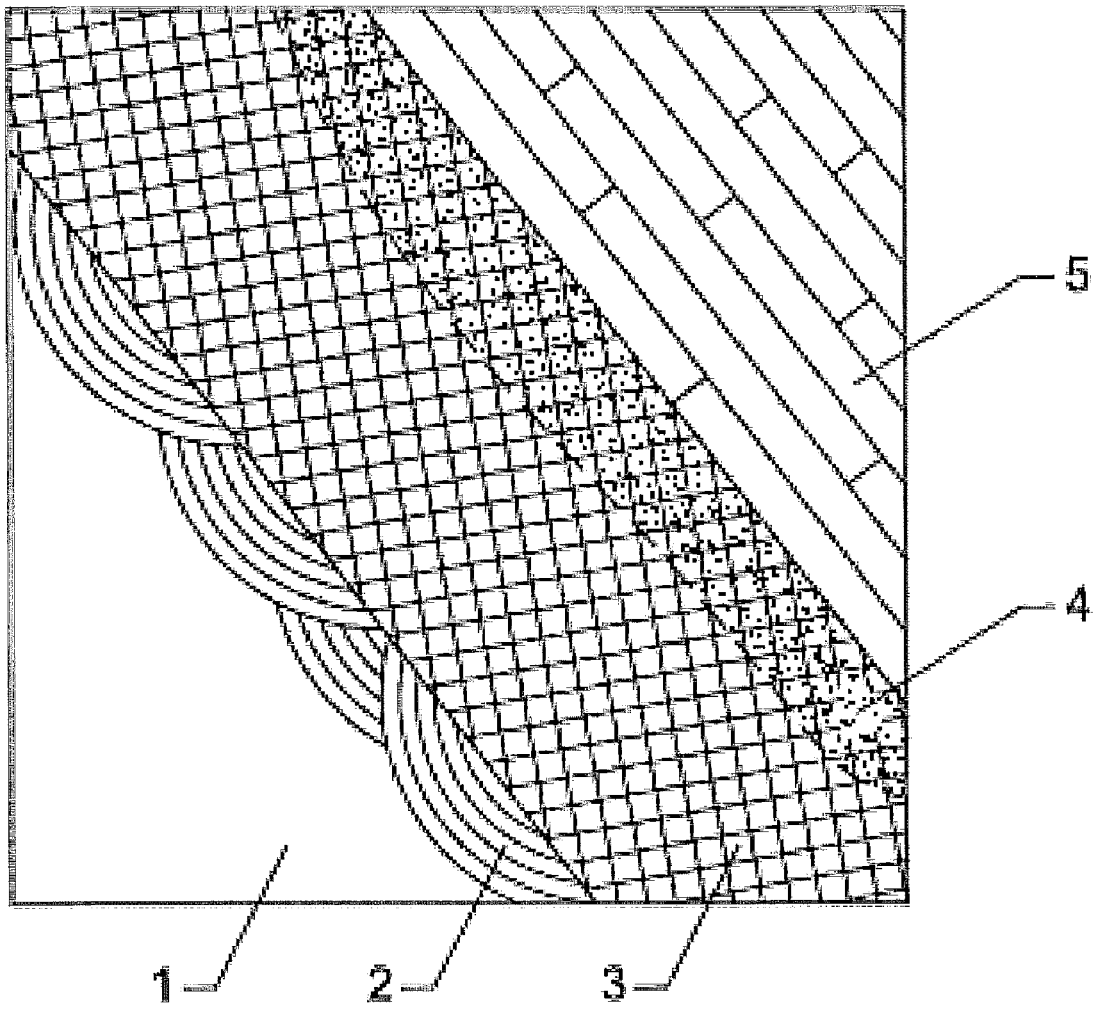
FIG. 1 shows a substrate partly covered with a wooden floor according to the invention.

FIG. 1 shows a wooden floor in the process of being laid. On a substrate 1, a first adhesive layer 2 is spread to cover the substrate 1. One or more studded plates 3 are laid on the adhesive layer 2. A second adhesive layer 4 is laid on the one or more studded plates, mainly filling the upper cavities in the studded plates. A wooden floor 5 is subsequently laid on the second adhesive layer 4.

Figure 2:
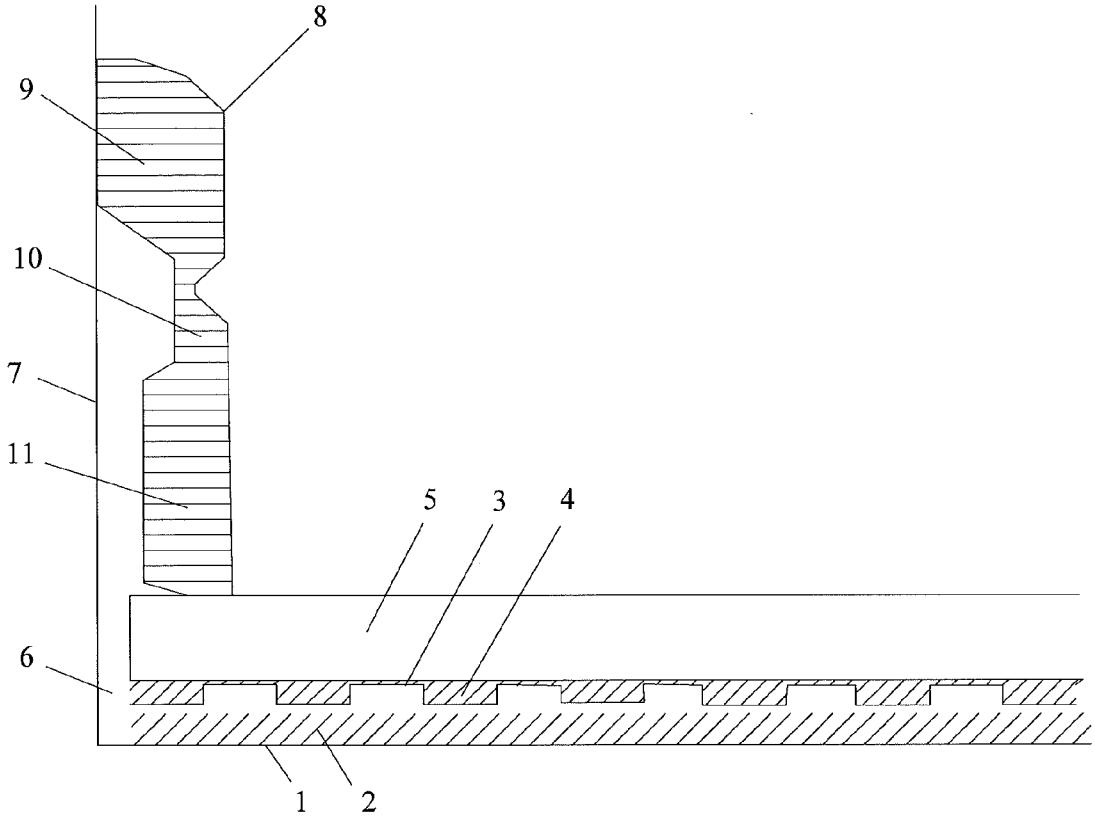
FIG. 2 shows a cross sectional side view of a floor according to the invention.

FIG. 2 shows a cross sectional view of the floor according to the invention. The first adhesive layer 2 is spread on the base substrate 1. However, a small gap 6 is left between the edge of the adhesive layer 2 on the substrate 1 and the adjacent walls 7. The gap 6 is maintained as the studded plate(s) 3, the second adhesive layer 4 and the wooden floor 5 are subsequently laid on the substrate.

As shown in FIG. 2, the shape of the studs may vary. The interior walls of the studs may contain narrowing walls from the opening towards the top of the stud, straight walls perpendicular to the plane of the plate, narrowing walls from the top and towards the opening of the stud (undercuts), or straight walls with overhangs (not shown) as mentioned above, or combinations thereof. Undercut walls or walls with an overhang are preferable in obtaining a good adhesion between the wooden floor 5 and the studded plate 3.

A skirting board 8 can thereafter be arranged on the wooden floor abutting the adjacent walls 7. The skirting board 8 preferably has cross-section comprising an upper part 9, a middle section 10 and a lower part 11. A recess is preferably provided in the middle section 10 on the side of the board facing the wall 7. The backwards surface of the lower part is preferably offset with regard to the backwards surface of the upper part. Thereby, a cavity is obtained between the wall 7 and the middle section and lower part of the skirting board 8, while the upper part of the board 8 abuts the wall 7. Such cavity improves aeration of the substrate.

Figure 3:
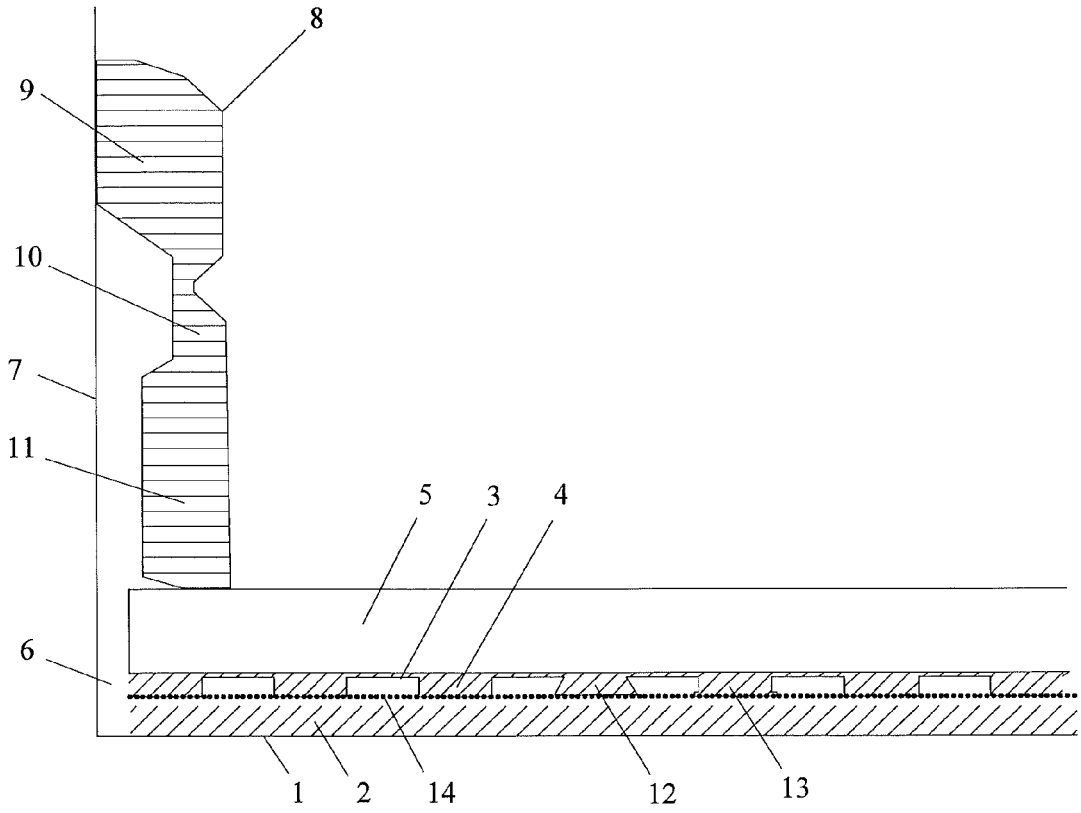
FIG. 3 shows a cross-sectional side view of a floor according to further embodiments of the present invention.

FIG. 3 shows a cross-sectional side view of a floor according to embodiments of the present invention comprising a stud featuring undercut walls 12, a stud with overhangs 13 and a net material 14 adhered or laminated to a side of the studded plates facing the substrate.

Figure 4:
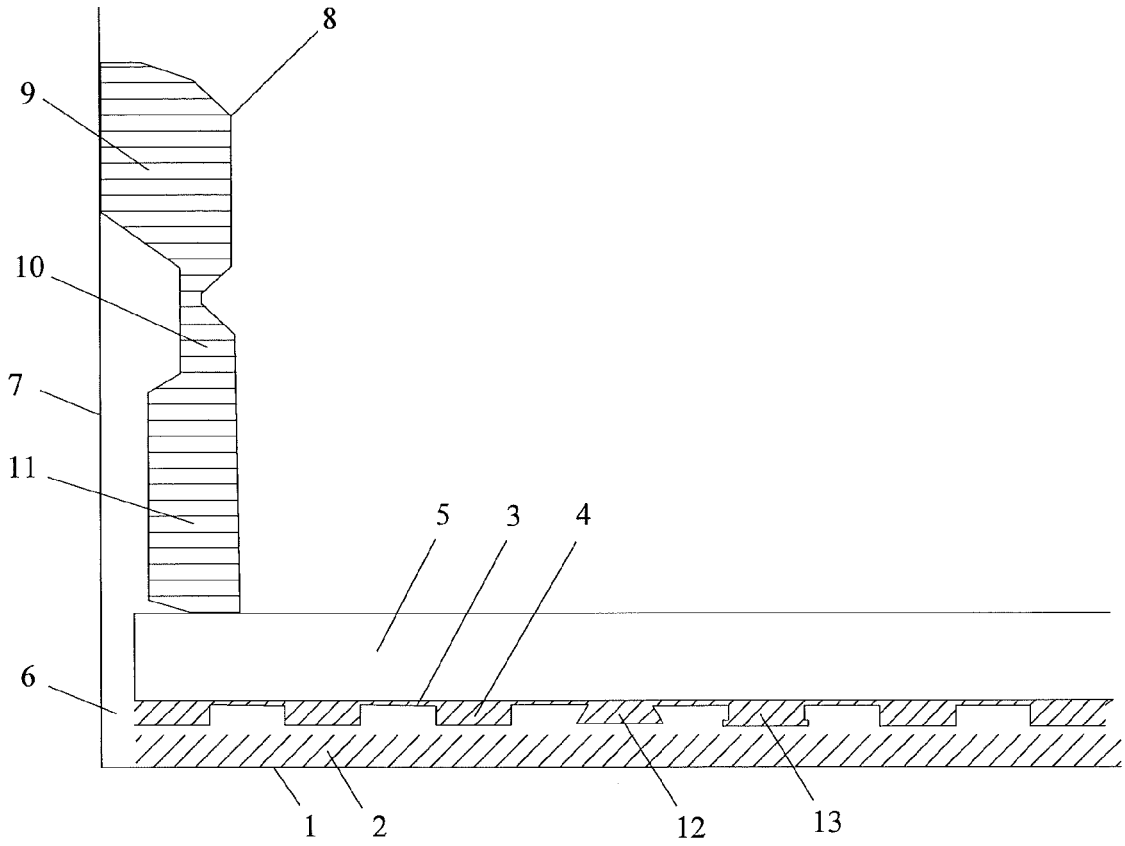
FIG. 4 shows a cross-sectional side view of a floor according to further embodiments of the present invention.

FIG. 4 shows a cross-sectional side view of a floor according to embodiments of the present invention as shown in FIG. 3, without the net material 14.

Figure 5:
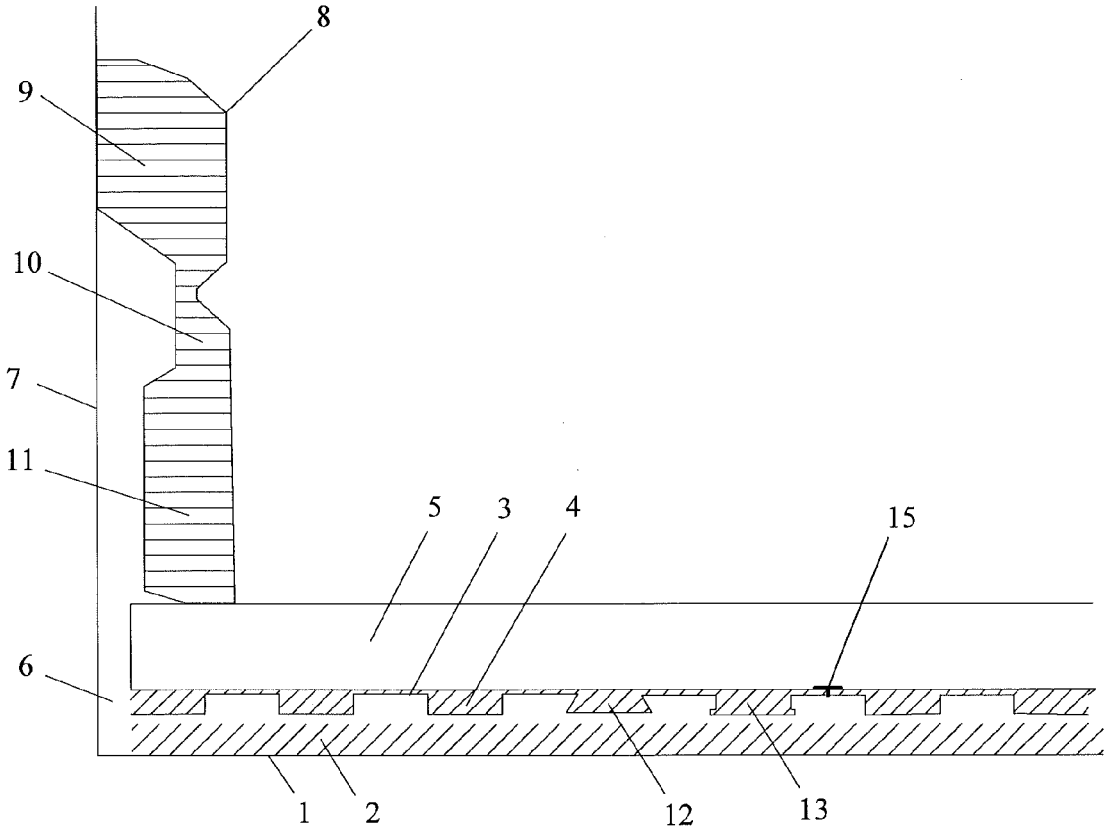
FIG. 5 shows a cross-sectional side view of a floor according to further embodiments of the present invention.

FIG. 5 shows a cross-sectional side view of a floor according to embodiments of the present invention including a feature of joining the studded plates by use of a sealing tape 15 on the top side of said plates.

The invention claimed is:

1. A floor comprising:

a substrate;

a studded plate atop the substrate;

a first bonding adhesive layer adhering a first surface of the studded plate to the substrate;

a wooden floor atop the studded plate and adhered to a second surface of the studded plate by a second bonding adhesive layer; and a sealing tape adhered to the second surface of the studded plate and joining edges of a plurality of studded plates together.

2. A floor according to claim 1, wherein the substrate is chosen from the group consisting of: light expanded clay aggregate concrete, lightweight concrete, plaster based floors, floating floors, floating floors screed, flooring substitute, and a floor substrate which is cured or hardened by using water.

3. A floor according to claim 1, wherein the studded plate comprises studs with overhangs, limiting the area of an opening of the studs in relation to the area of a top of the studs.

4. A floor according to claim 1, wherein the wooden floor includes parquet strips or boards, massive or laminated, in 2 or more layers.

5. A floor according to claim 1, wherein a non-woven material, a net material and/or a fabric material is laminated or adhered to the first surface of the studded plate and/or to the second surface of the studded plate.

6. A floor according to claim 1, wherein the studded plate comprises studs with undercut walls, limiting the area of an opening of the studs in relation to the area of a top of the studs.

7. A floor according to claim 1, wherein a fabric material is laminated or adhered to the first surface of the studded plate.

8. A floor according to claim 1, wherein the sealing tape seals joints formed by the plurality of studded plates.

9. A method of using studded plates for covering a substrate with a wooden floor, the method comprising adhering a first surface of a studded plate to the substrate using a first adhesive layer and adhering the wooden floor to a second surface of the studded plate using a second adhesive layer, and sealing a joint between a plurality of studded plates using a sealing tape adhered to the second surface of the studded plate.

10. The method according to claim 9, wherein the substrate is chosen from the group consisting of: light expanded clay aggregate concrete, lightweight concrete, plaster based floors, floating floors, floating floors screed, flooring substitute, and a floor substrate which is cured or hardened by using water.

11. The method according to claim 9, wherein the studded plate comprises studs with overhangs, limiting the area of an opening of the studs in relation to the area of a top of the studs.

12. The method according to claim 9, wherein the studded plate includes studs and a permeable material laminated or adhered to the studded plate and covering an opening of the studs, increasing adherence of adhesive filled in the studs to the studded plate.

13. The method according to claim 9, wherein a non-woven material and/or a net material is laminated or adhered to the first surface of the studded plate.

14. The method according to claim 9, wherein the studded plate comprises studs with a diameter or transversal length of about 5 to about 55 mm and a height of about 1 to about 10 mm.

15. The method of claim 9 wherein the studded plate comprises studs that are distributed over the studded plate with a distance between the studs of from about 1 mm to about 10 mm.

16. The method according to claim 9, wherein the studded plate comprises studs with undercut walls, limiting the area of an opening of the studs in relation to the area of a top of the studs.

17. The method according to claim 9, wherein a fabric material is laminated or adhered to the first surface of the studded plate.

* * * * *